US011248431B1

(12) United States Patent
Dossary

(10) Patent No.: US 11,248,431 B1
(45) Date of Patent: Feb. 15, 2022

(54) MAGNETIC FISHING TOOL AND USE THEREOF IN FISHING OPERATIONS

(71) Applicant: SAUDI ARABIAN OIL COMPANY, Dhahran (SA)

(72) Inventor: Abdullah S. Dossary, Abqaiq (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 16/935,344

(22) Filed: Jul. 22, 2020

(51) Int. Cl.
*E21B 31/06* (2006.01)
*E21B 17/042* (2006.01)

(52) U.S. Cl.
CPC ..... *E21B 31/06* (2013.01); *E21B 17/042* (2013.01)

(58) Field of Classification Search
CPC ..... E21B 31/06; E21B 17/042; E21B 31/00; E21B 31/007
See application file for complete search history.

(56) References Cited

U.S. PATENT DOCUMENTS

| | | | | |
|---|---|---|---|---|
| 3,011,819 | A | 12/1961 | Moseley, Jr. | |
| 3,905,631 | A | 9/1975 | Ricks et al. | |
| 4,749,044 | A | 6/1988 | Skipper et al. | |
| 5,348,086 | A | 9/1994 | Trout | |
| 2001/0013413 | A1 | 8/2001 | Ruttley | |
| 2007/0102161 | A1 | 5/2007 | Gazewood | |
| 2008/0060808 | A1 | 3/2008 | Gibson | |
| 2010/0186945 | A1 | 7/2010 | Hagen | |
| 2011/0030955 | A1* | 2/2011 | Braddick | E21B 31/00 166/301 |
| 2011/0042069 | A1* | 2/2011 | Bailey | E21B 41/00 166/244.1 |
| 2015/0211316 | A1* | 7/2015 | Skjeie | E21B 34/14 166/99 |
| 2017/0167216 | A1* | 6/2017 | Robertson | E21B 29/02 |
| 2017/0247980 | A1 | 8/2017 | Linklater et al. | |
| 2018/0363830 | A1* | 12/2018 | Baugh | E21B 31/00 |
| 2019/0162048 | A1 | 5/2019 | Engevik et al. | |
| 2019/0376357 | A1 | 12/2019 | Alssafwany | |
| 2020/0056438 | A1 | 2/2020 | Alssafwany | |

FOREIGN PATENT DOCUMENTS

| | | | |
|---|---|---|---|
| RU | 2272888 | C2 | 3/2006 |
| SU | 846714 | A1 | 7/1981 |

OTHER PUBLICATIONS

International Search Report and Written Opinion issued in Application No. PCT/US2020/047367, dated Feb. 17, 2021 (13 pages).

* cited by examiner

*Primary Examiner* — Michael R Wills, III
(74) *Attorney, Agent, or Firm* — Osha Bergman Watanabe & Burton LLP

(57) ABSTRACT

A method of removing a target fish from a wellbore includes preparing a fishing assembly having a magnetized pipe coupled to an end of a work string. The fishing assembly is run into the wellbore, and the magnetized pipe is positioned at an effective position in which a threaded end of the target fish is aligned with a threaded end of the magnetized pipe by magnetic attraction between the magnetized pipe and the target fish. A threaded connection is made up between the threaded end of the target fish and the threaded end of the magnetized pipe. The fishing assembly with the attached target fish is then retrieved from the wellbore to a surface location.

19 Claims, 12 Drawing Sheets

MAGNETIC FISHING TOOL AND USE THEREOF IN FISHING OPERATIONS

BACKGROUND

In the oilfield, the term "fish" is used to describe any item left in a wellbore. In some cases, fish may specifically refer to any item left in the wellbore that impedes further operations in the wellbore. During drilling operations, fish could be a drill string or parts of a drill string, such a drill pipe, drill collar, drill bit, logging tool, and other such items. The fish may be a result of the drill string experiencing mechanical sticking or mechanical failure during a drilling operation.

When there is a fish in a wellbore, a fishing operation may be carried out to remove the fish from the wellbore. Tubular fish, such as a pipe, may be retrieved from the wellbore using catch-type fishing tools such as overshots and spears. Overshots are external catch tools that engage the outer diameter of the fish, while spears are internal catch tools that engage the inner diameter of the fish. Overshots and spears have slip mechanisms, such as a grapple, to grip the fish. Once the fish is caught, force can be applied to the fish to release the fish from a stuck position, allowing the fish to be removed from the wellbore.

In some cases, a tubular fish may have exposed connection threads that allow a conventional drill pipe or screw-in sub to be used as a fishing tool. However, if the fish is misaligned in the wellbore due to the well conditions or fish position, it may not be possible to successfully connect to the fish and retrieve the fish using the drill pipe or screw-in sub.

SUMMARY

In a first summary example, a method of retrieving a fish from a wellbore includes preparing a fishing assembly including a magnetized pipe coupled to an end of a work string. The method includes running the fishing assembly into a wellbore containing a target fish. The magnetized pipe is positioned at an effective position in which a first threaded end of the target fish is aligned with a second threaded end of the magnetized pipe by magnetic attraction between the magnetized pipe and the target fish. A threaded connection between the first threaded end of the target fish and the second threaded end of the magnetized pipe is made up. The fishing assembly with the attached target fish is then retrieved from the wellbore to a surface location.

The threaded connection may be made up between the first and second threaded ends by inserting a pin of the second threaded end into a box of the first threaded end. The threaded connection may be made up by running the fishing assembly into the wellbore while rotating the fishing assembly relative to the target fish and until the second threaded end of the magnetized pipe is fully engaged with the first threaded end of the target fish. A predetermined torque may be applied to the threaded connection after the first and second threaded ends are fully engaged.

The method may include releasing the target fish from a stuck point in the wellbore after making up the threaded connection between the first and second threaded ends. The target fish may be released from the stuck position by applying a force to the target fish. The target fish may be released from the stuck position by pumping fluid through the fishing assembly and fish into the wellbore while applying the force to the target fish. The force may be applied to the target fish by operating one or more jars coupled between the magnetized pipe and the work string.

The method may include determining a stuck point in a drill string deployed in the wellbore prior to running the fishing assembly into the wellbore. The method may include parting the drill string above the stuck point, removing an upper part of the drill string from the wellbore, and leaving a lower part of the drill string in the wellbore as the target fish. The method may include parting the drill string by a back-off process that leaves the target fish with the first threaded end.

The method may include pumping a fluid through the fishing assembly into the wellbore prior to positioning the magnetized pipe at the effective position.

In a second summary example, an apparatus for retrieving a fish from a wellbore includes one or more pipes connected to form a work string and a magnetized pipe coupled to an end of the work string. The magnetized pipe has a threaded end for threaded engagement with a target fish in a wellbore.

The threaded end may include a threaded pin. The magnetized pipe may include a magnetized drill pipe. Alternatively, the magnetized pipe may include a magnetized screw-in sub. The apparatus may include at least one jar coupled between the end of the work string and the magnetized pipe. The jar may be operated to deliver an impact load to the target fish in the wellbore. The apparatus may include a stabilizer coupled to the magnetized pipe. The stabilizer may centralize the magnetized pipe within the wellbore. The apparatus may include at least one pipe protector disposed around an outer diameter of the magnetized pipe. The pipe protector may act as a spacer between the magnetized pipe and a wall of the wellbore with the target fish.

In a third summary example, a system for retrieving a fish from a wellbore includes a wellbore containing a tubular fish having a first threaded end exposed and a fishing assembly movably suspended in the wellbore. The fishing assembly includes one or more pipes connected to form a work string and a magnetized pipe coupled to an end of the work string. The magnetized pipe has a second threaded end to engage the first threaded end. The magnetized pipe is to be positioned proximate to the tubular fish to magnetically align the first threaded end with the second threaded end and to screw into the tubular fish.

The foregoing general description and the following detailed description are exemplary of the invention and are intended to provide an overview or framework for understanding the nature of the invention as it is claimed. The accompanying drawings are included to provide further understanding of the invention and are incorporated in and constitute a part of the specification. The drawings illustrate various embodiments of the invention and together with the description serve to explain the principles and operation of the invention.

BRIEF DESCRIPTION OF DRAWINGS

The following is a description of the figures in the accompanying drawings. In the drawings, identical reference numbers identify similar elements or acts. The sizes and relative positions of elements in the drawings are not necessarily drawn to scale. For example, the shapes of various elements and angles are not necessarily drawn to scale, and some of these elements may be arbitrarily enlarged and positioned to improve drawing legibility. Further, the particular shapes of the elements as drawn are not necessarily intended to convey any information regarding the actual shape of the particular elements and have been solely selected for ease of recognition in the drawing.

DETAILED DESCRIPTION

Figure 1:
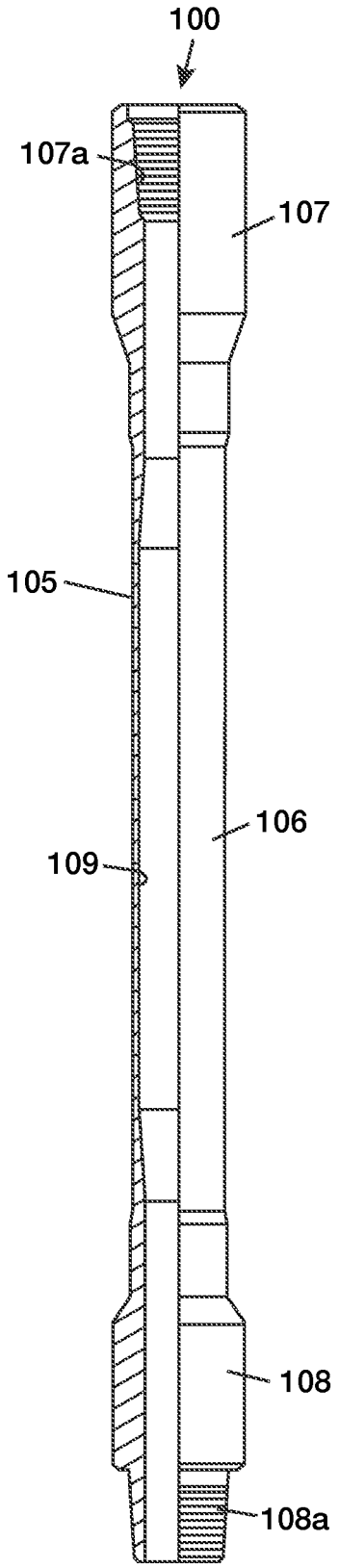
FIG. 1 is a partial cross-sectional view of a magnetized pipe.

In the following detailed description, certain specific details are set forth in order to provide a thorough understanding of various disclosed implementations and embodiments. However, one skilled in the relevant art will recognize that implementations and embodiments may be practiced without one or more of these specific details, or with other methods, components, materials, and so forth. In other instances, related well known features or processes have not been shown or described in detail to avoid unnecessarily obscuring the implementations and embodiments. For the sake of continuity, and in the interest of conciseness, same or similar reference characters may be used for same or similar objects in multiple figures.

The disclosure relates to retrieval of a drill string from a wellbore when the drill string, or a portion thereof, is left in the wellbore as a fish. A screw-in fishing tool that can magnetically align a fish with itself and screw into the fish is described. Two example scenarios in which the screw-in fishing tool may be used are described. In one of the scenarios, the drill string is stuck in the wellbore. In the other scenario, the drill string has parted unintentionally in the wellbore. However, the screw-in fishing tool is not restricted to retrieval of a drill string and may be used whenever it is possible to retrieve a fish by screwing into the fish.

FIG. 1 shows one illustrative implementation of a screw-in fishing tool 100 that can be run into a wellbore to screw into a fish in the wellbore. Screw-in fishing tool 100 includes a magnetized pipe 105, which is a pipe that has been made into a permanent or long-lasting magnet, i.e., a magnet that is able to generate its own persistent magnetic field. The term "long lasting" herein may mean at least the duration of a procedure to retrieve a fish from a wellbore. Magnetized pipe 105 has a pipe body 106 and pipe ends 107, 108 joined to pipe body 106. Pipe end 107 has a threaded box 107*a* for making a threaded connection. Pipe end 108 has a threaded pin 108*a* for making a threaded connection. Magnetized pipe 105 has a conduit 109 running through pipe body 106 and pipe ends 107, 108. Conduit 109 may allow passage of fluid through magnetized pipe 105. In one implementation, the pipe preform used in making magnetized pipe 105 is a conventional drill pipe. In this case, magnetized pipe 105 differs from a conventional drill pipe in that magnetized pipe 105 is a permanent or long lasting magnet whereas the conventional drill pipe is not.

Figure 2:
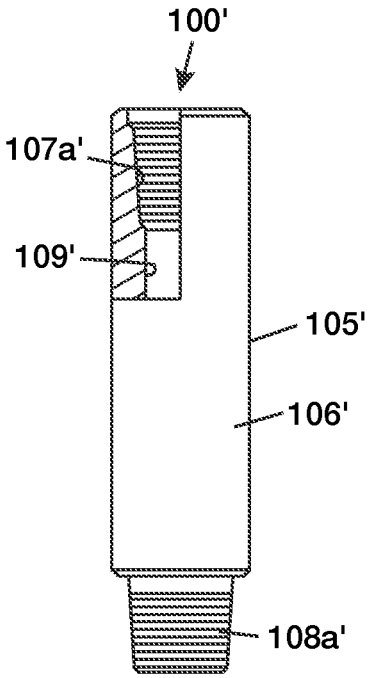
FIG. 2 is a partial cross-sectional view of another magnetized pipe.

In an alternative screw-in fishing tool 100' shown in FIG. 2, magnetized pipe 105' is formed by magnetizing a screw-in sub. Magnetized pipe 105' has a pipe body 106' with a threaded box 107*a*' at one pipe end and a threaded pin 108*a*' at the other pipe end. Threaded box 107*a*' and threaded pin 108*a*' are for making threaded connections. Pipe body 106' also has a conduit 109'. Therefore, magnetized pipe 105' in FIG. 2 is structurally equivalent to magnetized pipe 105 in FIG. 1. The main difference between magnetized pipes 105', 105 is in the pipe length, the magnetized pipe based on the drill pipe being longer. In general, the magnetized pipe of the screw-in fishing tool could be made of a conventional drill pipe or screw-in sub. Alternatively, the magnetized pipe of the screw-in fishing tool could be formed by magnetizing other types of pipes besides the conventional drill pipe and the screw-in sub. An advantage of using a conventional drill pipe or screw-in sub as the pipe preform for the magnetized pipe may be that these pipes already meet the standards set by the American Petroleum Institute (API) for downhole operations and are readily available.

Figure 3:
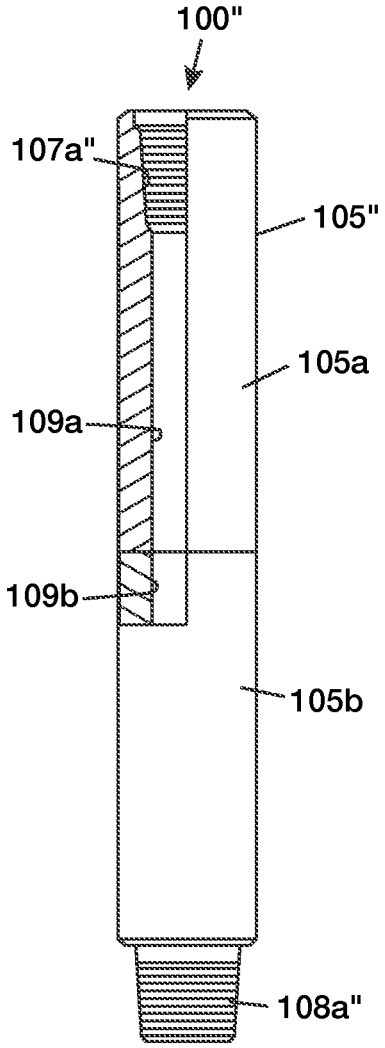
FIG. 3 is a partial cross-sectional view of a multi-piece magnetized pipe.

In some cases, a magnetized pipe may have multiple magnetized pipe pieces to allow better control of its overall magnetic strength. In the alternative screw-in fishing tool 100" shown in FIG. 3, magnetized pipe 105" is formed from two magnetized pipe pieces 105*a*, 105*b* that are magnetically connected together. The magnetized pipe pieces may be prepared by magnetizing two separate pipe preforms, which may or may not have the same pipe lengths. Magnetized pipe pieces 105*a*, 105*b* may be held together by magnetic attraction, e.g., similar to stacking magnets. Magnetized pipe 105*a* has a threaded box 107*a*" for making a threaded connection and a conduit 109*a*. Magnetized pipe 105*b* has a threaded pin 108*a*" for making a threaded connection and a conduit 109*b*. Conduits 109*a*, 109*b* are fluidly connected for passage of fluid. Thus, magnetized pipe 105" is structurally equivalent to magnetized pipe 105 in FIG. 1 or magnetized pipe 105' in FIG. 2.

To form the magnetized pipe, a pipe preform fabricated using ferromagnetic material, such as steel, or other magnetizable material suitable for downhole environments and able to carry weight is obtained. The pipe preform may be a conventional drill pipe, a screw-in sub, or other type of pipe suitable for use downhole. The pipe preform is then magnetized using any effective method, such as stroking the pipe with a magnet in a direction along an axial axis of the pipe; hanging the pipe vertically and repeatedly hammering one end of the pipe, optionally followed by heating the pipe; or inducing a magnetic field in the pipe with electrical current. Preferably, the pipe reaches full magnetic saturation during the magnetization process. Preferably, the magnetized pipe has sufficient magnetic strength to pull an end of a target fish in a wellbore into alignment with an axial axis of the magnetized pipe. For the multi-piece magnetized pipe, multiple pipe preforms are fabricated, magnetized, and then assembled to form a single magnetized pipe.

Figure 4:
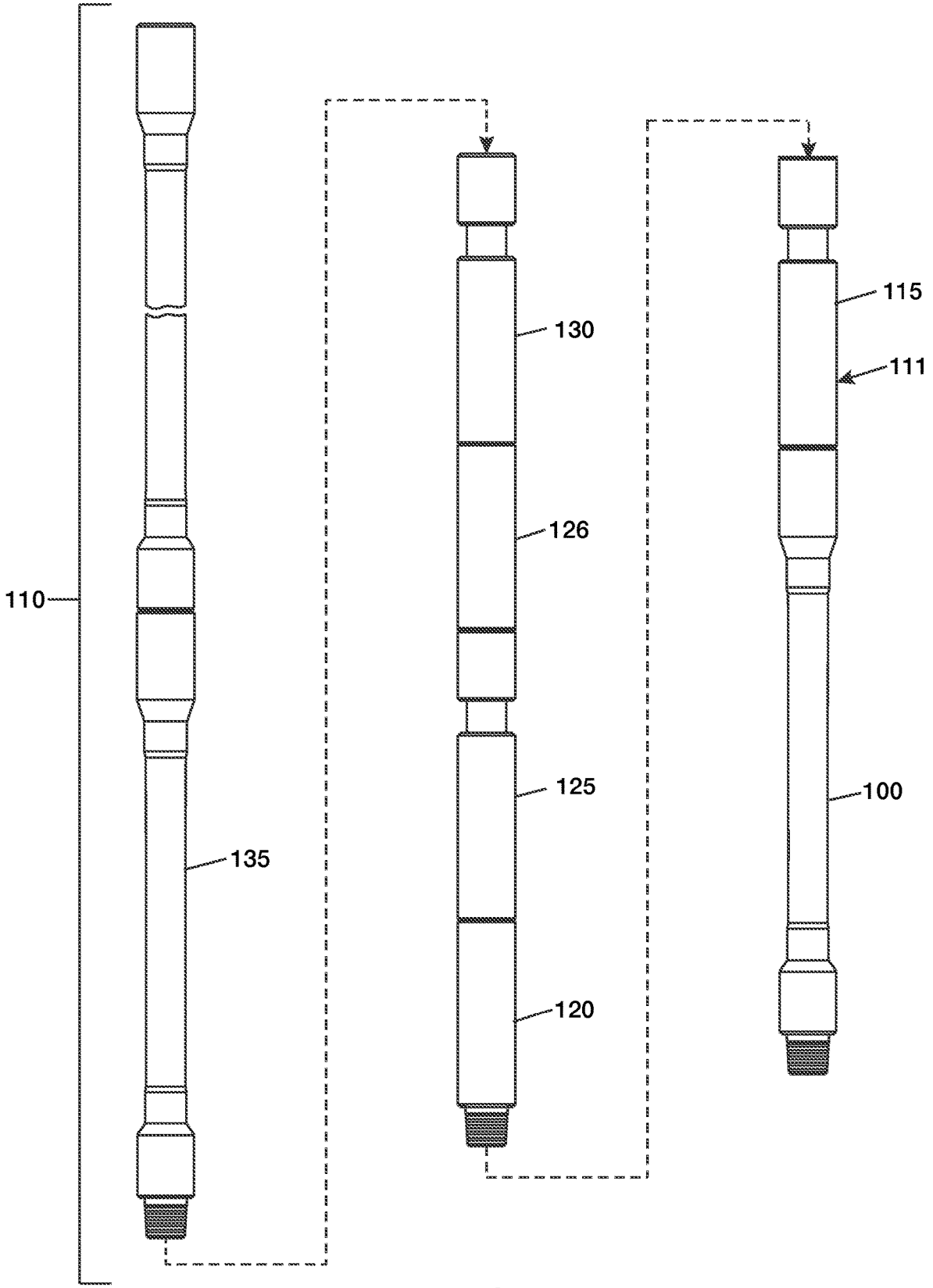
FIG. 4 is a schematic diagram of a fishing assembly incorporating a magnetized pipe.

To use the screw-in fishing tool in a retrieval procedure, the screw-in fishing tool is incorporated into a fishing assembly. Any of the variants of the screw-in fishing tool shown in FIGS. 1-3 could be incorporated in a fishing assembly. For illustrative purposes, FIG. 4 shows a fishing assembly 110 including a jarring assembly 111 and screw-in fishing tool 100. The various tool portions in FIG. 4 will be connected end to end as shown by the dotted lines.

In the illustrated example shown in FIG. 4, which should not be considered as limiting, jarring assembly 111 includes a bumper jar (also, bumper sub) 115, drill collar(s) 120, a fishing jar 125, drill collar(s) 126, intensifier jar (also, accelerator or booster jar) 130, and a work string 135. The various jars are known in the art and available commercially. In general, bumper jar 115 strokes vertically downward to deliver an impact load to a fish. Fishing jar 125 may be a hydraulically operated or mechanically operated jar. An oil jar is a common example of a hydraulic fishing jar. Fishing jar 120 strokes vertically upward to deliver an impact load to a fish. Drill collars 120, 126 provide the weight to deliver the impact loads. Intensifier jar 130 is positioned to increase the jarring force provided by fishing jar 120. The various jars and drill collars are in tubular form and have threaded pipe ends for threaded connections. These jars also have conduits that will allow fluid passage through the fishing assembly. Work string 135 may be made of one or more joints of drill pipe and is used to run the fishing assembly into the wellbore. Work string 135 can be lengthened as fishing assembly 110 is run into the wellbore by adding joints of drill pipe. When running fishing assembly 110 into the wellbore, screw-in fishing tool 100 will be at the bottom end of the fishing assembly and in a position to screw into a fish, and work string 135 will be at the top end of the fishing assembly.

Figure 5:
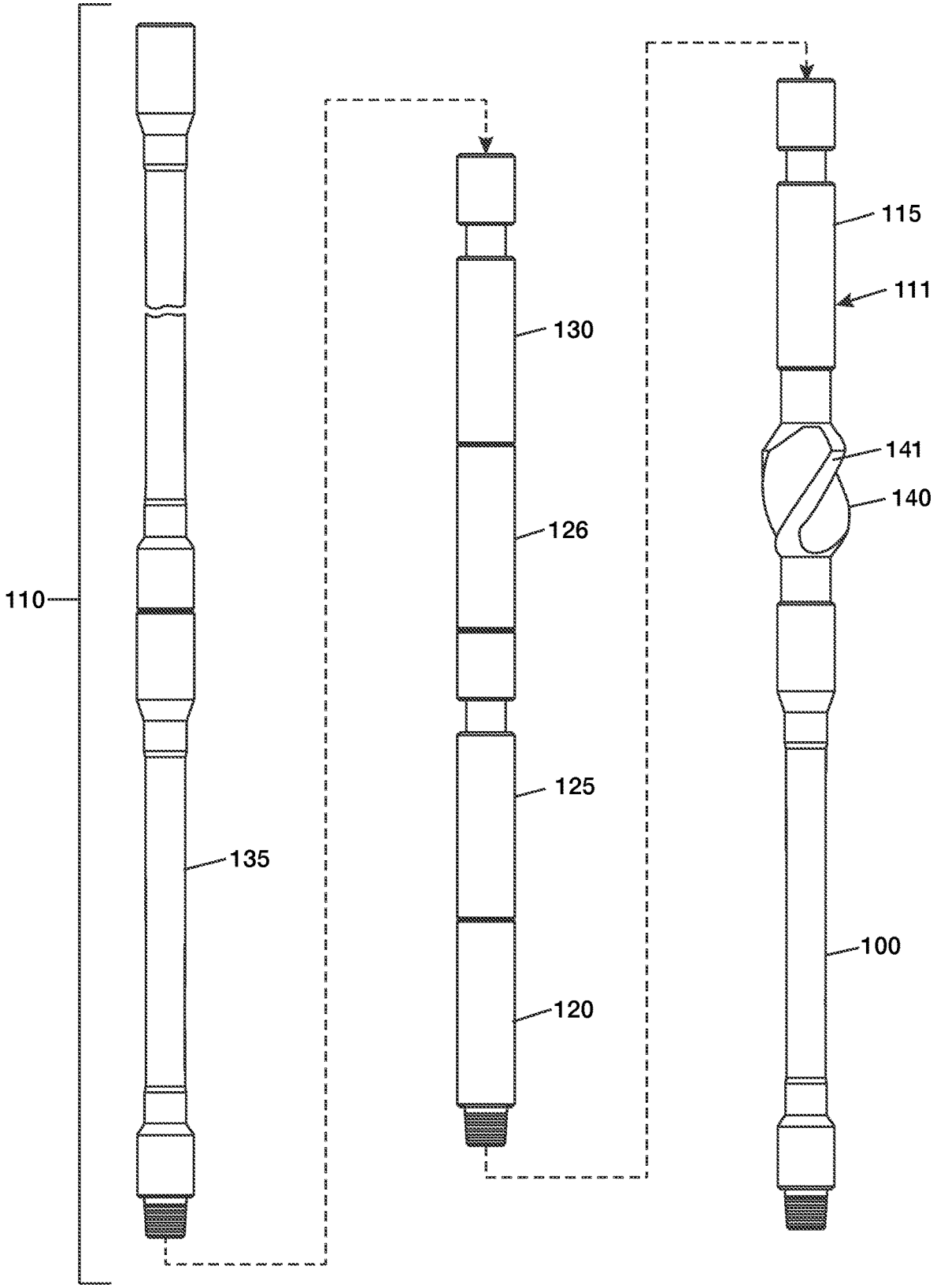
FIG. 5 is a schematic diagram of a fishing assembly showing a stabilizer positioned above the magnetized pipe of FIG. 4.
Figure 6:
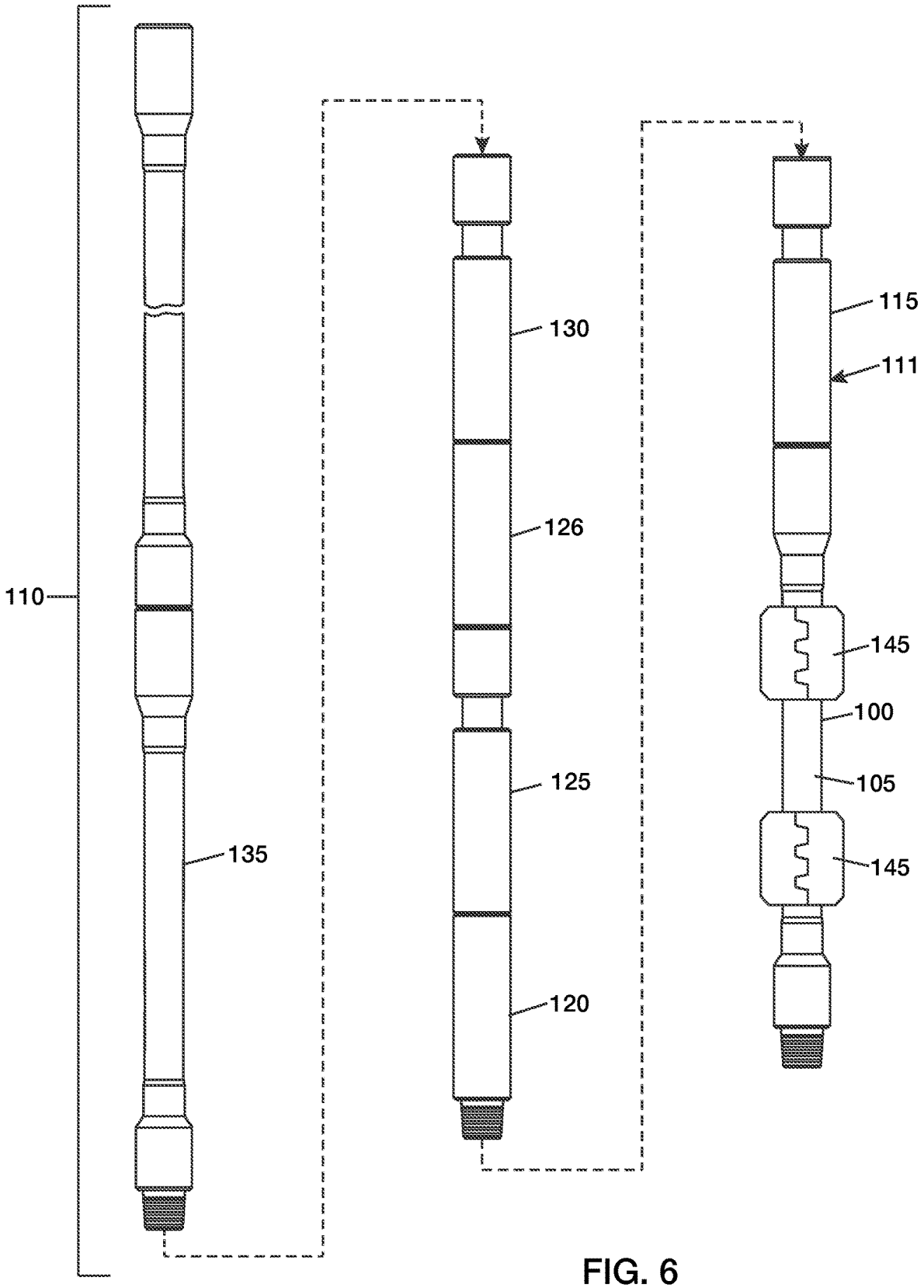
FIG. 6 is a schematic diagram of a fishing assembly showing drill pipe protectors positioned around the magnetized pipe of FIG. 4.

When running fishing assembly 110 through a cased section of a wellbore, there is the possibility of screw-in fishing tool 100 magnetically latching onto the casing in the wellbore, resulting in decentering of fishing assembly 110 in the wellbore. To keep fishing assembly 110 in the center of the wellbore, one or more stabilizers may be incorporated in fishing assembly 110. FIG. 5 shows an example where a stabilizer 140 is positioned above screw-in fishing tool 100. Stabilizer 140 is a tubular body carrying blades 141 that will act as spacers between fishing assembly 110 and the wall of the wellbore without blocking flow of fluid around fishing assembly 110. Blades 141 may be spiral as shown or may be straight. If stabilizer 140 above screw-in fishing tool 100 is not sufficient to keep fishing assembly 110 centered in the wellbore, a stabilizer could also be positioned below screw-in fishing tool 100. In this case, the stabilizer below could be a short stabilization point so as not to interfere with the ability of the magnetized pipe to align a fish in a wellbore. Also, in this case, the stabilizer could provide the screw-in end of the fishing tool. FIG. 6 shows another example where pipe protectors 145 are fitted around an outer diameter of magnetized pipe 105. Pipe protectors 145 will act as a barrier between magnetized pipe 105 and a casing in a cased section of a wellbore and may minimize the likelihood of magnetized pipe 105 latching onto the casing. Pipe protectors 145 may be ring-shaped bodies molded from rubber or other non-magnetic material suitable for the downhole environment.

Figure 7:
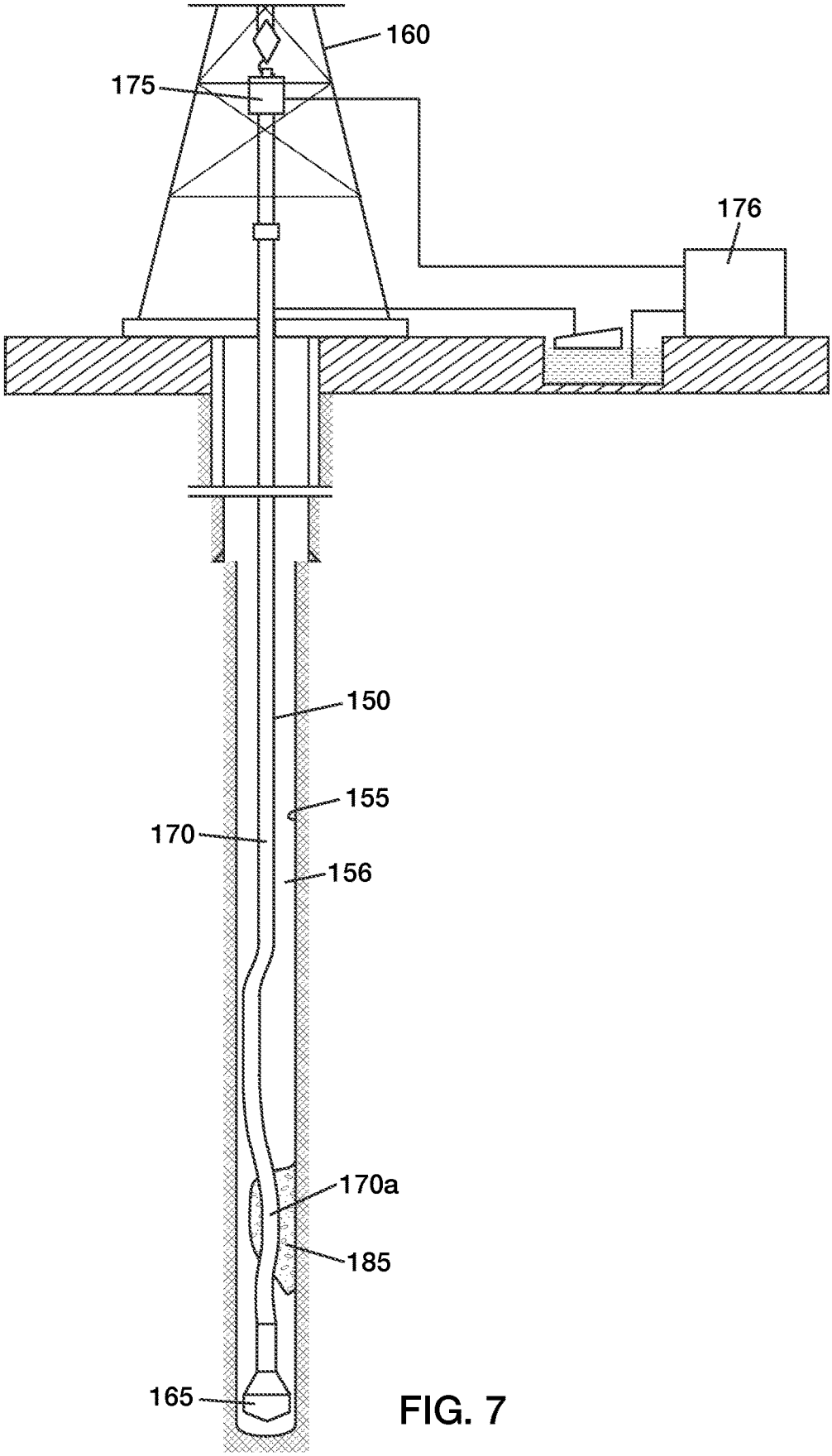
FIG. 7 is a schematic diagram of a drill string stuck in a wellbore.

FIG. 7 shows a drill string 150 hanging in a wellbore 155 from a derrick 160. Drill string 150 includes a drill bit 165 to cut rock formations and drill pipes 170 forming a conduit from drill bit 165 to the surface. Drill string 150 may include other accessories not specifically mentioned but known in the art. The configuration of a drill string will typically depend on the drilling plan for the wellbore. During normal operations, drill string 150 may be rotated within wellbore 155 by a top drive 175 (or by a rotary table on a rig floor), which will result in rotation of drill bit 165, enabling drill bit 165 to advance cutting of the rock formation. As the drill string 150 is rotated, drilling fluid may be circulated through wellbore 155 by operating a pump 176 at the surface to pump fluid into drill string 150. The drilling fluid exits drill string 150 through drill bit 165 and rises up an annulus 156 between drill string 150 and wellbore 155 to the surface.

In the particular scenario shown in FIG. 7, drill string 150 is stuck in wellbore 155. For illustrative purposes, a section 170*a* of drill string 150 has been sucked into a mud cake 185 on a wall of wellbore 155 by differential pressure and is stuck in mud cake 185, making it impossible to safely rotate drill string 150. However, there are various other ways in which a drill string can be stuck in a wellbore, and the scenario shown in FIG. 7 is just an example. Upon detecting that drill string 150 is stuck, an attempt to retrieve the drill string from the wellbore may be made.

Figure 8:
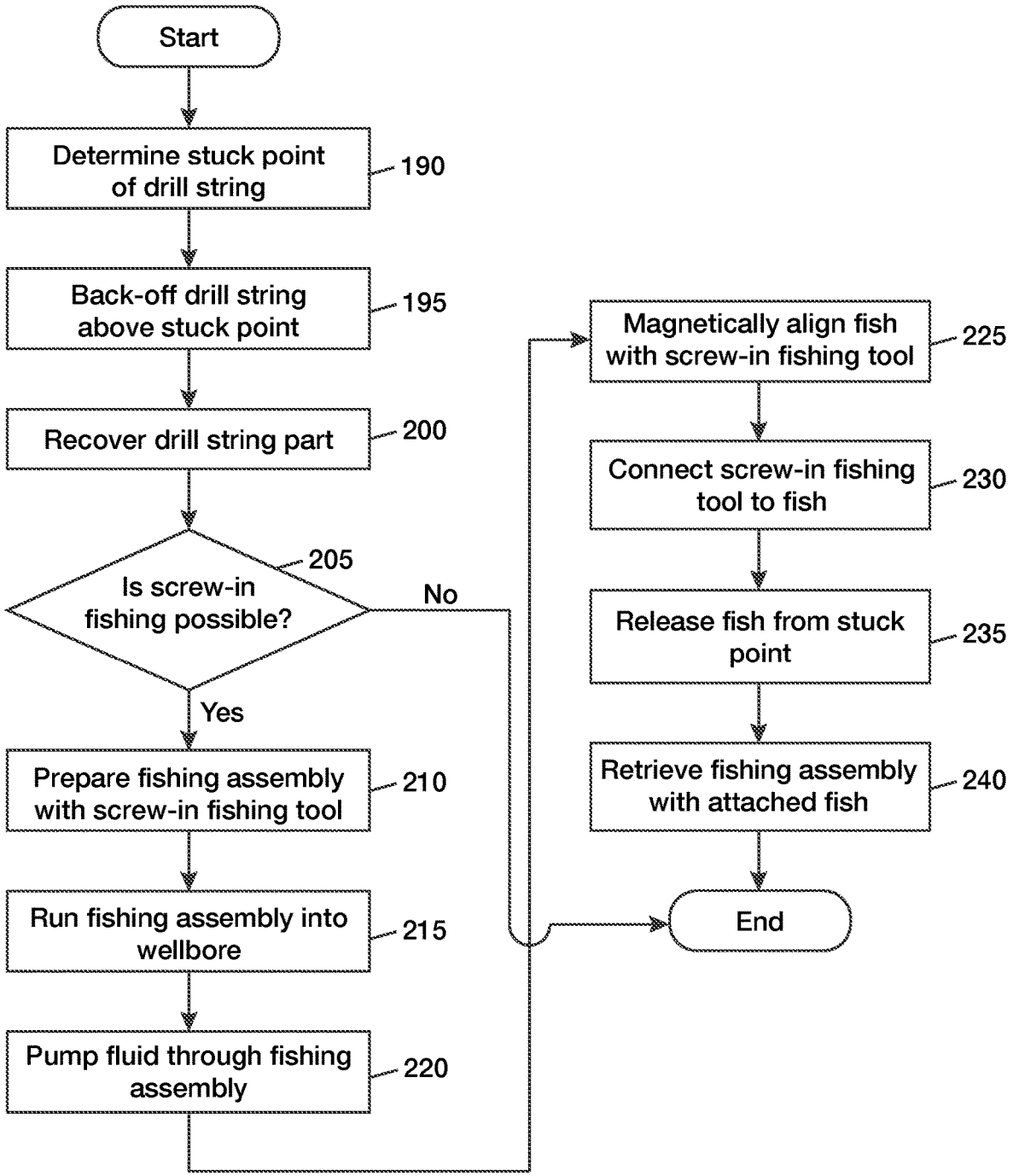
FIG. 8 is a flowchart illustrating a method of retrieving a stuck drill string from a wellbore.

FIG. 8 is a flowchart illustrating an example method of retrieving a stuck drill string from a wellbore using the screw-in fishing tool. The method includes determining a stuck point of the drill string, i.e., the depth at which the drill string is stuck in the wellbore (190). The stuck point may be determined using a free point indicator or other method known in the art. The free point indicator is a wireline that is run into the drill string and that measures a stretch in the drill string. When tension is applied to the drill string, the portion of the drill string above the stuck point will stretch. The free point indicator measures this stretch. The free point indicator may be run along the drill string until such a point that a stretch in the drill string is not detected, which would indicate the location of the stuck point.

The method includes backing off the drill string above the stuck point (195). The drill string includes components that are connected together by threaded joints. Back-off is an operation that is performed to part a drill string at a threaded joint. The operation may include loosening the selected threaded joint using a prima cord explosive that is run on an electric wireline and applying a back-off torque to the drill string to unscrew the drill string at the loosened threaded joint. The back-off operation will leave an upper part of the drill string that is suspended from the surface and a lower part of the drill string that is separated from the upper part of the drill string.

Figure 9:
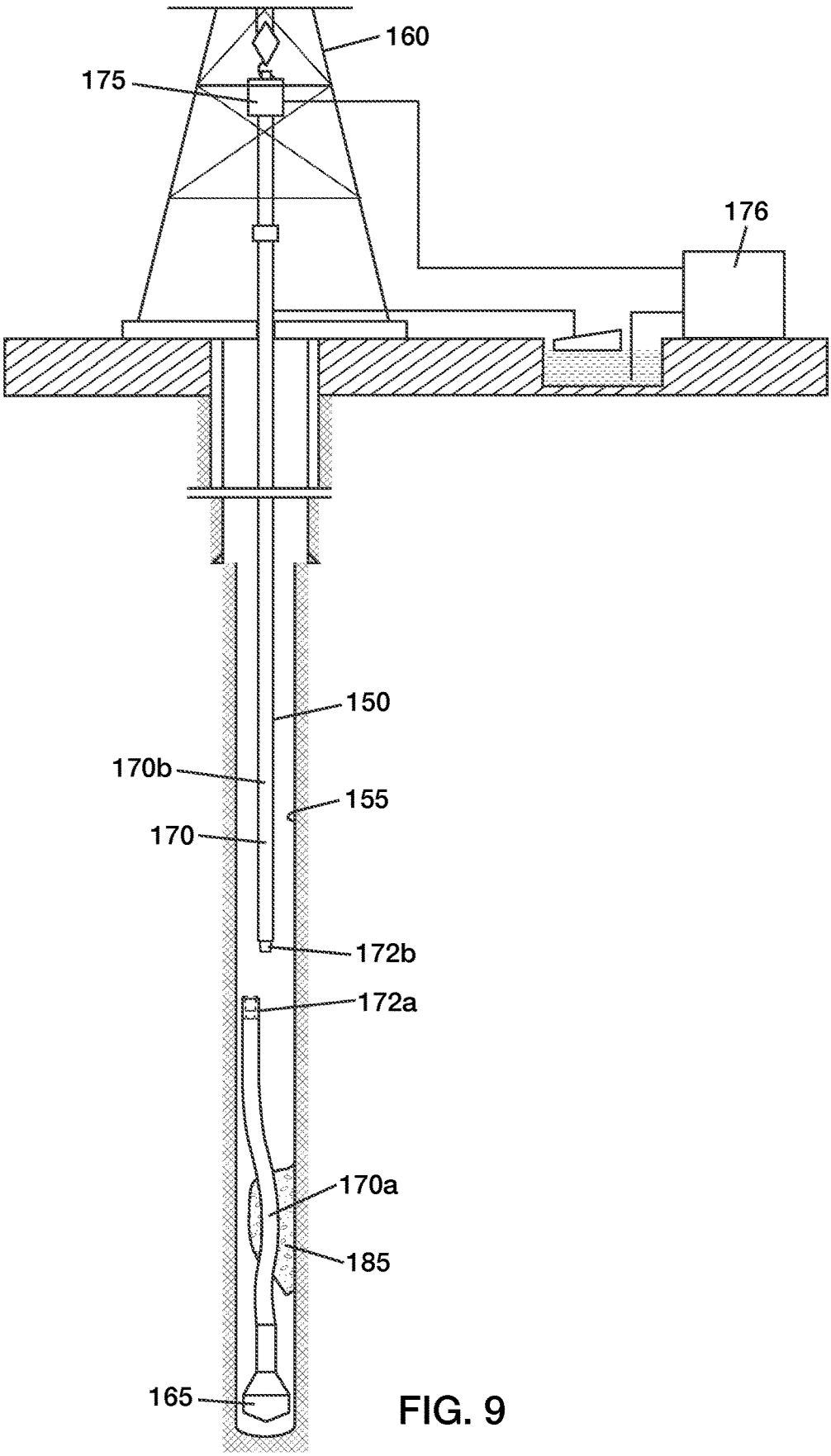
FIG. 9 is a schematic diagram of a drill string part being retrieved from a wellbore after a back-off operation.

The method includes retrieving the upper part of the drill string using normal procedures for tripping out a drill string (200). This will leave the lower part of the drill string in the wellbore as a fish. FIG. 9 shows the upper part 170*b* of the drill string being retrieved from the wellbore and the lower part 170*a* of the drill string that remains as a fish in the wellbore. If the back-off operation is successful, one half of the threaded joint will be at the top end 172*a* of fish 170*a*, and the other half of the threaded joint will be at the bottom end 172*b* of drill string 170*b*. Typically, the half of the threaded joint at the top end 172*a* of fish 170*a* will be a threaded box, and the half of the threaded joint at the bottom end 172*b* of drill string 170*b* will be a threaded pin.

Upon retrieving drill string part 170*b* to the surface, the method includes determining if screw-in fishing is possible for the fish in the wellbore (205 in FIG. 8). In one example, this includes inspecting the threaded pin at the bottom end of drill string part 170*b* and using the condition of the threaded pin as a proxy for the condition of the threaded box of fish 170*a* in the wellbore. If the threaded pin is in a good condition, it may be concluded that the threaded box of fish 170*a* is also in a good condition.

If the threaded connection of the fish is determined to be in a good condition, the method includes preparing the fishing assembly by coupling the screw-in fishing tool to a work string (210 in FIG. 8). The prepared fishing assembly may also include various tools for performing a jarring action. In one example, the fishing assembly may be assembled as shown in any of FIGS. 4-6.

The method includes running the fishing assembly into the wellbore. Joints of drill pipe may be added to the work string as the fishing assembly is run into the wellbore to enable the fishing assembly to reach the desired depth in the wellbore. Running the fishing assembly into the wellbore means continuously lowering the fishing assembly into the wellbore and towards the fish. The screw-in fishing tool will be at the bottom of the fishing assembly.

When the fishing assembly is at a predetermined distance from the fish, the method includes commencing pumping of fluid through the screw-in fishing tool (220 in FIG. 8). The fluid is pumped from the surface into the fishing assembly. The fluid exits the fishing assembly and washes down debris in and around the fish. The predetermined distance from the fish may be about 180 ft (180 ft corresponds to one stand of pipe and is commonly used as a reference in washdown operations). However, the predetermined distance is not limited to 180 ft. In general, it suffices that the screw-in fishing tool is positioned where fluid coming out of the screw-in fishing will be effective in washing down debris in and around the fish.

Figure 10:
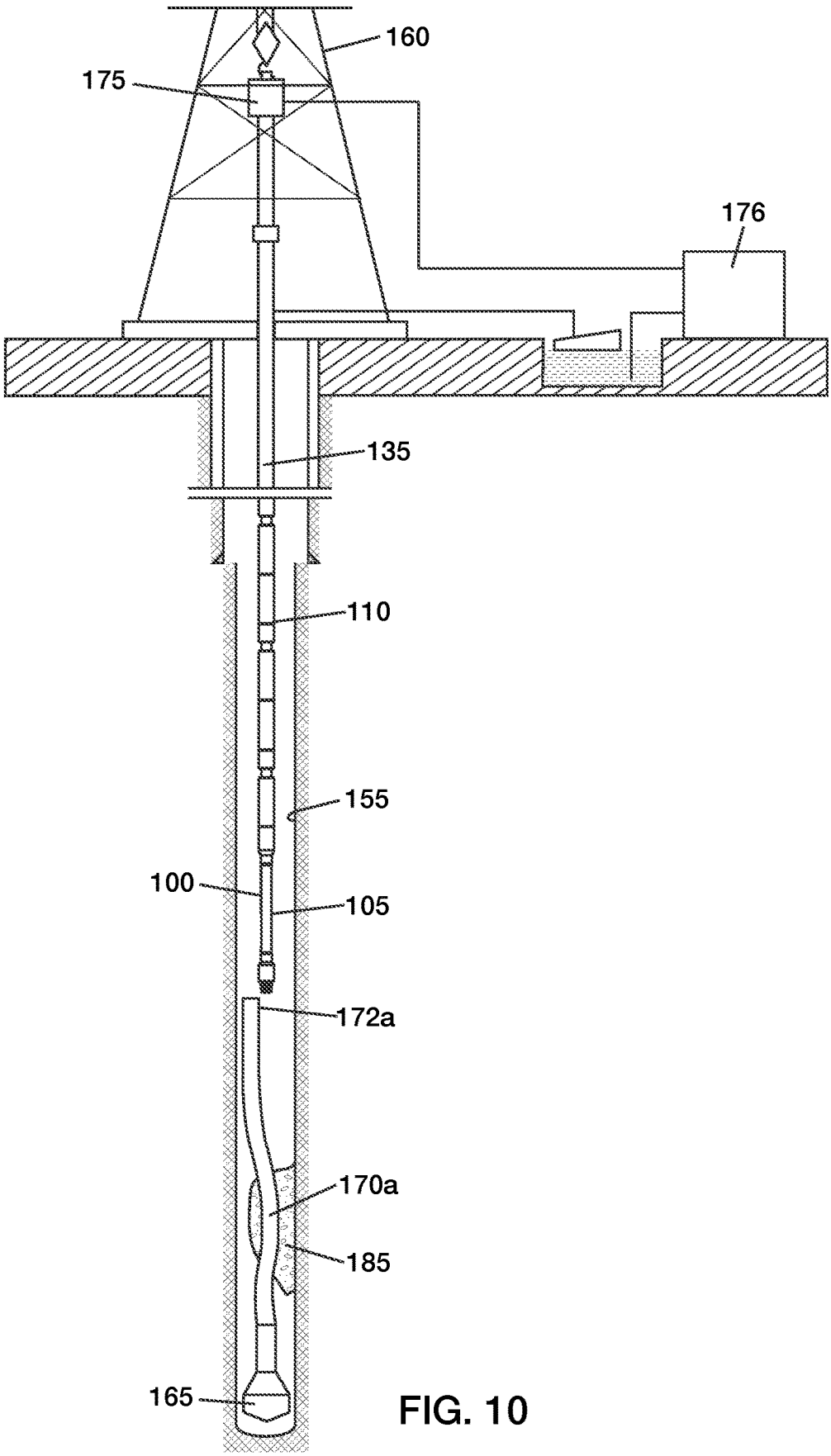
FIG. 10 is a schematic diagram of a magnetized pipe positioned in close proximity to a fish in a wellbore.
Figure 11:
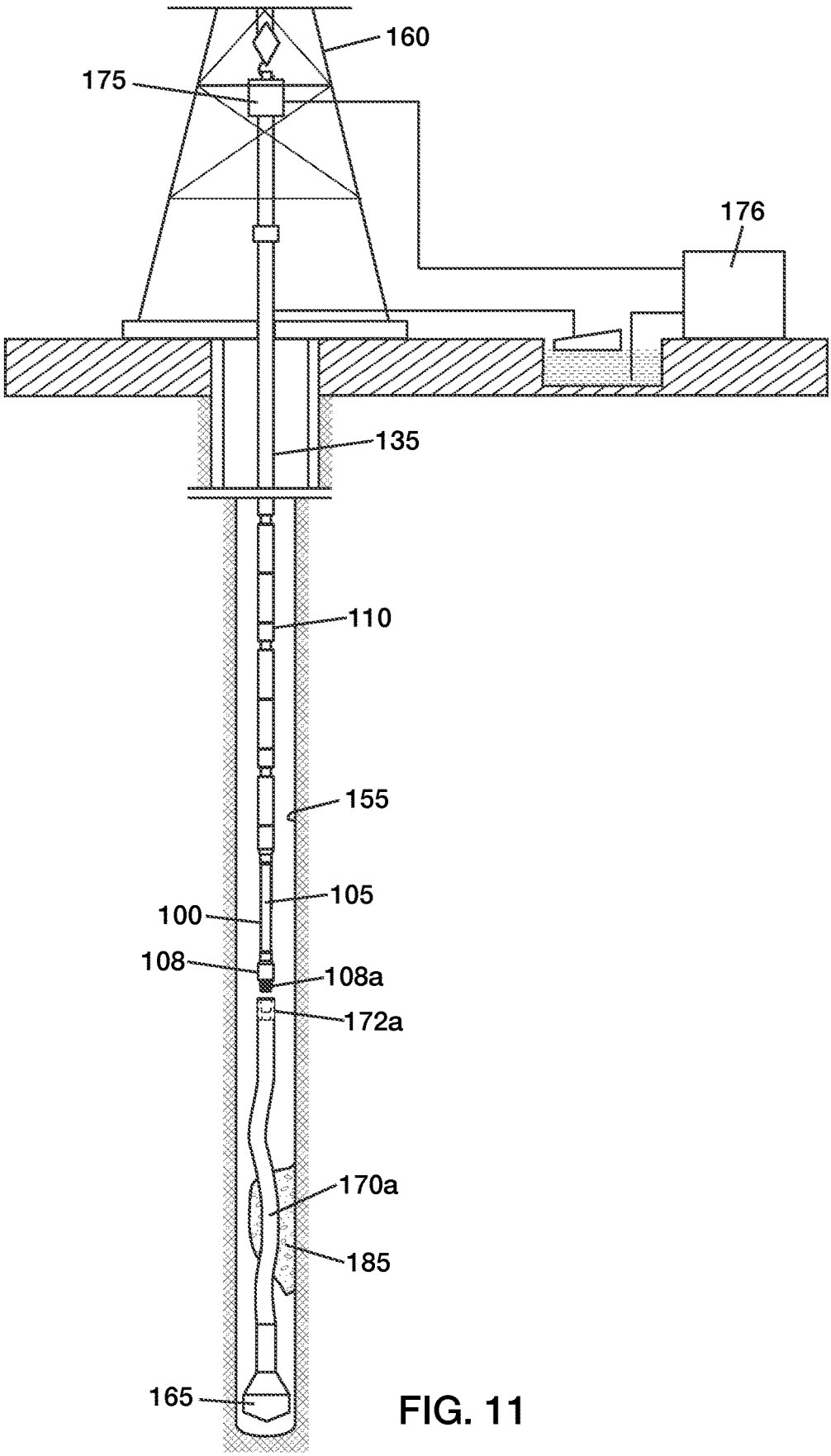
FIG. 11 is a schematic diagram of a fish aligned with a magnetized pipe by magnetic attraction.

The method includes continuing running of the fishing assembly until the bottom end of the screw-in fishing tool is in close proximity to the top end of the fish, e.g., within 1 ft of the fish or within a distance in which the top end of the fish will be under the influence of the magnetic field of the magnetized pipe of the screw-in fishing tool. An attempt may be made to tap the screw-in fishing tool against the top end of the fish. The screw-in fishing tool is held in close proximity to the top of the fish, i.e., running of the fishing assembly is paused, for a period of time sufficient to allow the top end of the fish to align with the bottom end of the screw-in fishing tool magnetic attraction (225 in FIG. 8). The time may be several minutes, e.g., about 15 minutes in an open hole or about 30 minutes in a cased hole. In general, the attempt to align the fish could be repeated as needed. FIG. 10 shows screw-in fishing tool 100 in close proximity to fish end 172*a*. FIG. 11 shows fish end 172*a* axially aligned with pipe end 108 of screw-in fishing tool 100 by magnetic attraction. In particular, the threaded box at fish end 172*a* is aligned with the threaded pin 108*a* at pipe end 108. Circulation of fluid through the fishing assembly could be paused or may continue while aligning the fish with the screw-in fishing tool.

Figure 12:
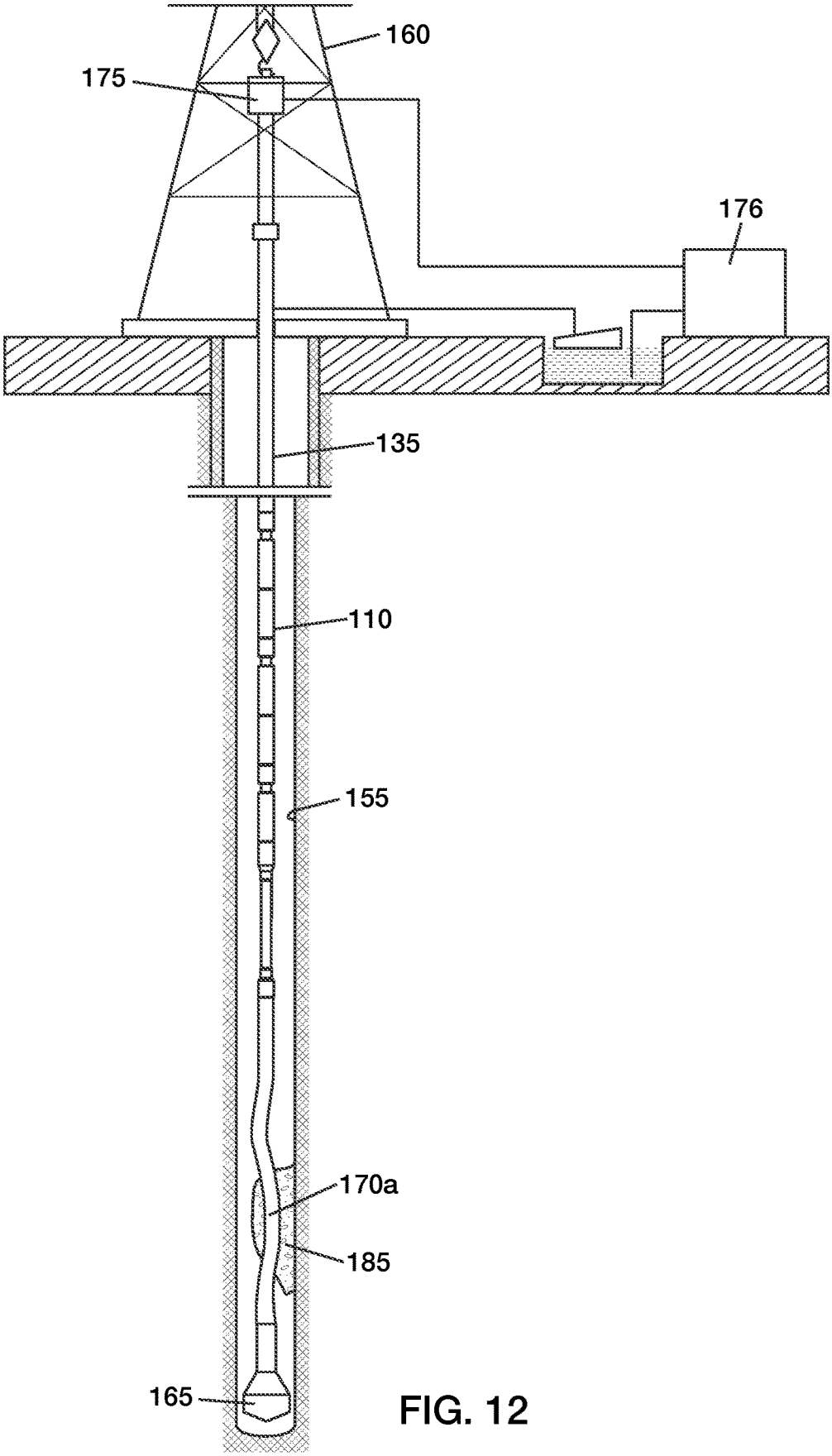
FIG. 12 is a schematic diagram of a magnetic pipe connected to a fish in a wellbore.

The method includes screwing the screw-in fishing tool into the fish (230 in FIG. 8) In one example, the fishing assembly is run slowly and rotated slowly until the threaded pin 108 at the end of the screw-in fishing tool is inside the threaded box at the fish end 172*a*. The slow running and rotation continues until the threaded connection between screw-in fishing tool 100 and fish 170*a* has been fully made up. Then, fishing assembly 110 is further rotated to apply a predetermined torque to the threaded connection that is based on the type of threaded connection. FIG. 12 shows fish 170*a* fully attached to fishing assembly 110 via screw-in fishing tool 100.

Figure 13:
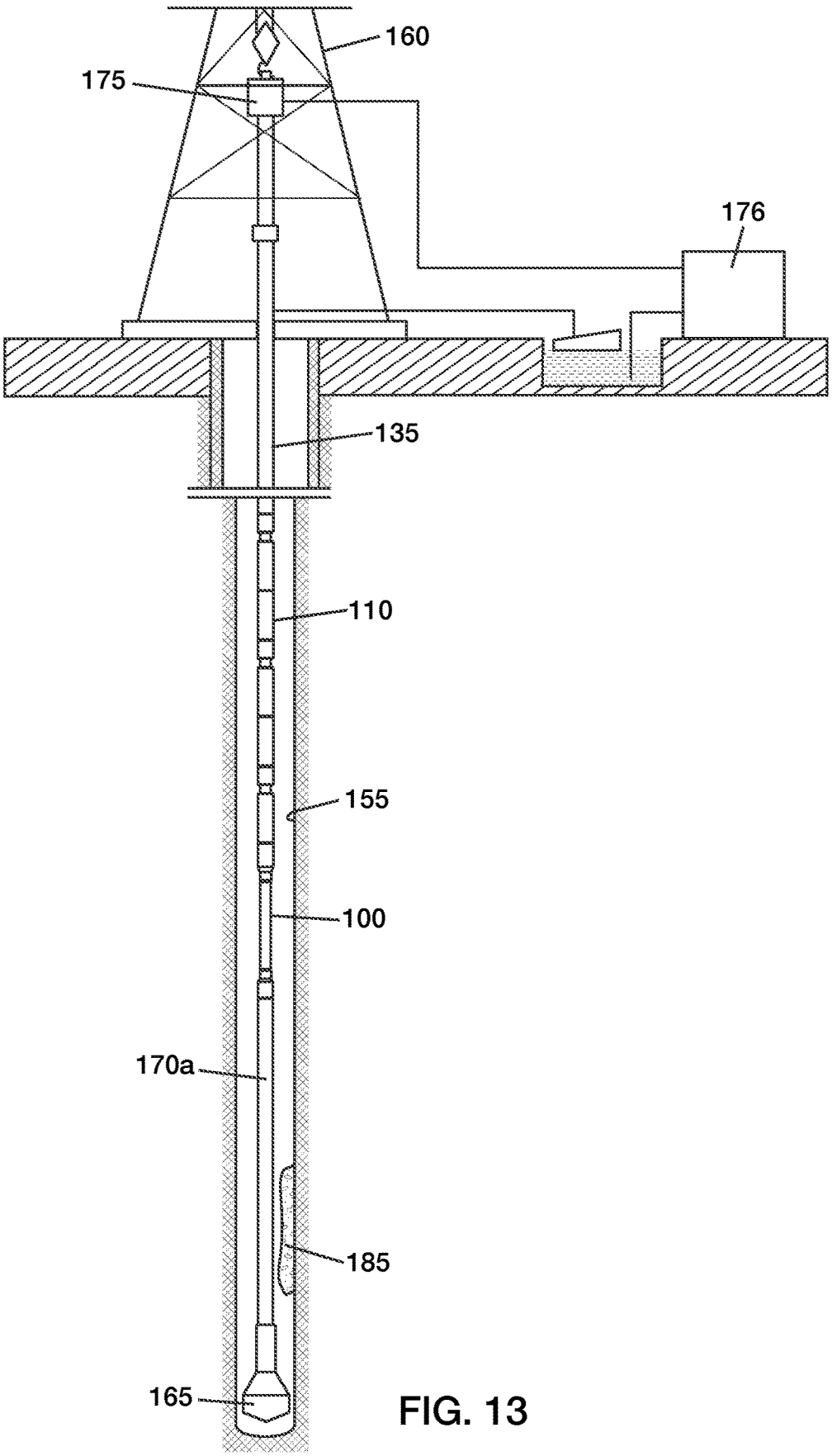
FIG. 13 is a schematic diagram of a fishing assembly and fish after releasing the fish from a stuck point.

With the connection between the fish and screw-in fishing tool fully made up, force is applied to the fish to release the fish from the stuck point (235 in FIG. 8). In one example, fluid is pumped down fishing assembly 110 and fish 107*a* into the wellbore 155. At the same time, fishing assembly 110 is pulled from the surface to apply a force to fish 107*a* in order to release fish 107*a* from the stuck point. If necessary, the jars in fishing assembly 110 may be operated to apply an impact load to fish 107*a*. Any and all of the previously described jars may be used. FIG. 13 shows fish 170*a* released from the stuck point.

The method includes retrieving fishing assembly 110 with fish 170*a* attached to the screw-in fishing tool 100 to the surface (240 in FIG. 8). The retrieval of the fishing assembly can be similar to normal procedures for removing a drill string from a wellbore. During the retrieval, fluid is circulated through the fishing assembly and fish into the wellbore and up the annulus between the fishing assembly and the wellbore. As the fishing assembly is pulled out of the wellbore, the fishing assembly is broken down. Normal operations can resume once the fish is out of the wellbore.

In the case of a drill string that is backed-off unintentionally, the retrieval process can be achieved in acts 200 to 240 of FIG. 8. In this case, a back-off operation (195 in FIG. 8) will not be needed since the drill string has already parted.

The detailed description along with the summary and abstract are not intended to be exhaustive or to limit the embodiments to the precise forms described. Although specific embodiments, implementations, and examples are described herein for illustrative purposes, various equivalent modifications can be made without departing from the spirit and scope of the disclosure, as will be recognized by those skilled in the relevant art.

The invention claimed is:

1. A method comprising:

coupling a fishing assembly to an end of a work string, wherein the fishing assembly comprises a magnetized drill pipe having a solid wall body;

running the fishing assembly into a wellbore containing a target fish;

positioning the magnetized drill pipe at an effective position in which a first threaded end of the target fish is aligned with a second threaded end of the magnetized drill pipe by magnetic attraction between the magnetized drill pipe and the target fish;

making up a threaded connection between first threaded end of the target fish and the second threaded end of the magnetized drill pipe; and retrieving the fishing assembly with the attached target fish from the wellbore to a surface location.

2. The method of claim 1, wherein making up the threaded connection between the first and second threaded ends comprises inserting a pin of the second threaded end into a box of the first threaded end.

3. The method of claim 1, wherein making up the threaded connection comprises running the fishing assembly into the wellbore while rotating the fishing assembly relative to the target fish and until the second threaded end of the magnetized drill pipe is fully engaged with the first threaded end of the target fish.

4. The method of claim 3, further comprising applying a predetermined torque to the threaded connection after the first and second threaded ends are fully engaged.

5. The method of claim 1, further comprising releasing the target fish from a stuck point in the wellbore after making the threaded connection between the first and second threaded ends.

6. The method of claim 5, wherein releasing the target fish from the stuck position comprises applying a force to the target fish.

7. The method of claim 6, wherein releasing the target fish from the stuck position comprises pumping fluid through the fishing assembly and fish into the wellbore while applying the force to the target fish.

8. The method of claim 6, wherein applying the force to the target fish comprises operating one or more jars coupled between the magnetized drill pipe and the work string.

9. The method of claim 1, further comprising prior to running the fishing assembly into the wellbore, determining a stuck point in a drill string deployed in the wellbore.

10. The method of claim 9, further comprising parting the drill string above the stuck point, removing an upper part of the parted drill string from the wellbore, and leaving a lower part of the parted drill string in the wellbore as the target fish.

11. The method of claim 10, wherein parting the drill string is by a back-off process that leaves the target fish with the first threaded end.

12. The method of claim 1, further comprising pumping a fluid through the fishing assembly into the wellbore prior to positioning the magnetized drill pipe at the effective position.

13. An apparatus comprising:

one or more pipes connected to form a work string; and a magnetized drill pipe, having a solid wall body, coupled to an end of the work string, the magnetized drill pipe having a threaded end for threaded engagement with a target fish in a wellbore.

14. The apparatus of claim 13, wherein the threaded end includes a threaded pin.

15. The apparatus of claim 13, wherein the magnetized drill pipe includes a magnetized screw-in sub.

16. The apparatus of claim 13, further comprising at least one jar coupled between the end of the work string and the magnetized drill pipe, the jar operable to deliver an impact load to the target fish in the wellbore.

17. The apparatus of claim 13, further comprising a stabilizer coupled to the magnetized drill pipe, the stabilizer to centralize the magnetized drill pipe within the wellbore.

18. The apparatus of claim 13, further comprising at least one pipe protector disposed around an outer diameter of the magnetized drill pipe, the at least one pipe protector to act as a spacer between the magnetized drill pipe and a wall of the wellbore with the target fish.

19. A system comprising:

a wellbore containing a tubular fish having a first threaded end exposed; and a fishing assembly movably suspended in the wellbore, the fishing assembly comprising one or more pipes connected to form a work string and a magnetized drill pipe, having a solid wall body, coupled to an end of the work string, the magnetized drill pipe having a second threaded end to engage the first threaded end, the magnetized drill pipe to be positioned proximate to the tubular fish to magnetically align the first threaded end with the second threaded end and to screw into the tubular fish.

* * * * *